United States Patent [19]

Hanson

[11] 4,375,345

[45] Mar. 1, 1983

[54] CLAMPING ARM ASSEMBLY FOR A BACKHOE

[75] Inventor: Charles B. Hanson, Burlington, Iowa

[73] Assignee: J. I. Case Company, Racine, Wis.

[21] Appl. No.: 286,342

[22] Filed: Jul. 23, 1981

[51] Int. Cl.[3] ..... B66F 9/00

[52] U.S. Cl. ..... 414/722; 37/117.5; 37/DIG. 3; 414/729

[58] Field of Search ..... 414/722, 694, 724, 729, 414/740, 622; 294/70, 104, 106, 67 AB; 37/2 R, DIG. 3, DIG. 12, 117.5

[56] References Cited

U.S. PATENT DOCUMENTS

| | | | |
|---|---|---|---|
| 3,273,729 | 9/1966 | Holopainen | 414/694 |
| 3,807,589 | 4/1974 | Shovick | 37/2 R X |
| 4,327,509 | 5/1982 | Bean | 37/DIG. 3 X |

FOREIGN PATENT DOCUMENTS

| | | | |
|---|---|---|---|
| 761783 | 6/1967 | Canada | 414/740 |

*Primary Examiner*—Robert J. Spar
*Assistant Examiner*—Donald W. Underwood
*Attorney, Agent, or Firm*—Dressler, Goldsmith, Shore, Sutker & Milnamow, Ltd.

[57] ABSTRACT

An improved clamping arm assembly for a backhoe or similar excavator includes an arm link adapted to be fixedly mounted beneath the lower surface of the dipper arm of the excavator. A clamping arm is pivotally connected with the arm link, and is movable into and out of engagement with the bucket of the excavator by a fluid actuator in order to provide a claw-like working action. The clamping arm assembly includes a pair of mounting plates respectively disposed on opposite sides of the dipper arm which are adapted to engage support pins on the arm, and a lock bolt arrangement for detachably fixing the assembly to the dipper arm of the excavator.

12 Claims, 7 Drawing Figures

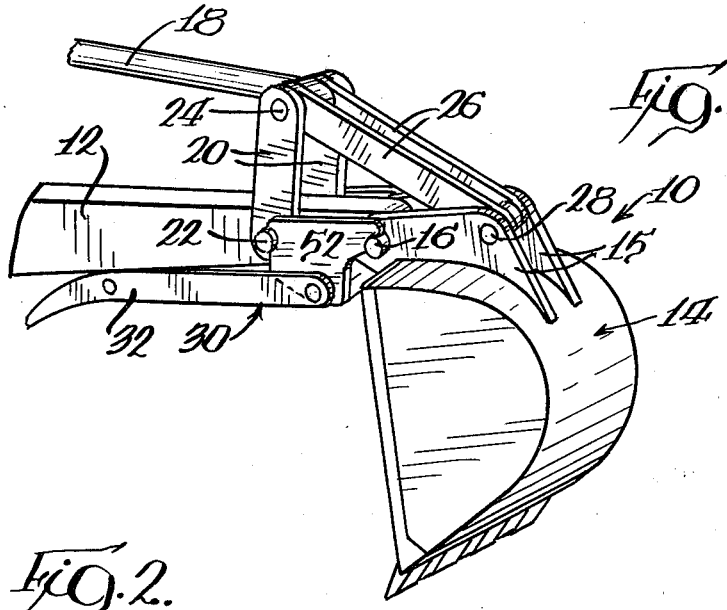
Fig. 1.
Fig. 2.
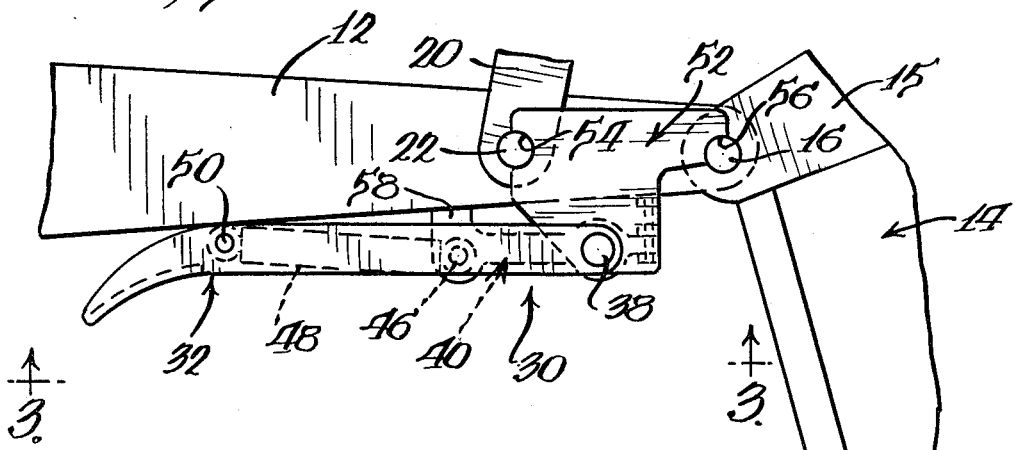
Fig. 3.
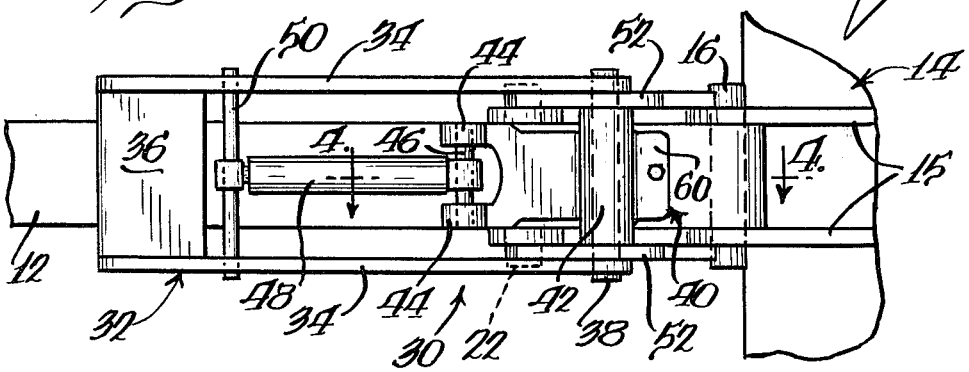

CLAMPING ARM ASSEMBLY FOR A BACKHOE

FIELD OF INVENTION

This invention relates generally to material handling equipment, and more particularly to an improved clamping arm assembly for use with a backhoe or similar excavator.

BACKGROUND OF THE INVENTION

Backhoes and similar excavators are used for a wide variety of material handling and excavation purposes. Equipment of this nature generally includes an articulated arm supported by a ground supported frame, and a bucket assembly pivotally mounted to the distal end of the arm. Hydraulic fluid actuators provide selective movement of the arm and bucket assembly for performing a wide variety of digging and scooping material handling operations. the versatility of equipment of this nature is well recognized, and backhoes and similar excavators are commonly used for a great variety of construction jobs and the like.

Because the working action of excavators of this nature typically involves scooping or curling movement of the bucket assembly, these type of excavators are not particularly well suited to moving objects which require a grasping or claw-like working action. Because of the added versatility which a working action of this nature provides, hydraulically actuated clamping arms are frequently installed on the articulated arm of the backhoe. These assemblies typically include a pivoted clamping arm which is movable into and out of engagement with the bucket of the backhoe. In this way, a claw-like working action is provided which accommodates manipulation and moving of objects which ordinarily the bucket assembly alone would be unable to handle. For instance, arrangements of this nature accommodate the movement of logs, pipes, and other elongated objects. Because these arrangements provide for grasping of objects rather than the usual scooping provided by the bucket alone, the versatility of the backhoe or similar excavator is greatly increased. U.S. Pat. No. 3,273,729 to Holopainen, illustrates a typical arrangement of this nature.

Heretofore, clamping arm assemblies as described above have typically required specialized mountings for installation on the excavator. For instance, one commonly used arrangement for a backhoe includes a clamping arm pivotally connected to the dipper arm of the backhoe near or at the pivotal support of the bucket. A fluid actuator is pivotally connected to the dipper arm near its mounting to the boom of the backhoe, and extends therefrom to a pivotal connection with the clamping arm intermediate its ends. Mounting of a clamping arm assembly of this nature usually requires a weld-on bracket on the dipper arm for pivotally supporting one end of the fluid actuator. Although this arrangement provides the added versatility associated with clamping arm assemblies, transfer of the assembly from one excavator to another requires that a welded-on mounting or equivalent be provided for attachment of the assembly. Additionally, clamping arms of this description may interfere with equipment mounted on the backhoe, such as lighting fixtures. Thus, a clamping arm assembly for use with a backhoe or similar excavator which would preclude the necessity of providing specialized mounting arrangements would facilitate transfer of the assembly from one piece of machinery to another.

SUMMARY OF THE INVENTION

The subject invention provides an improved clamping arm assembly for use with a backhoe or similar excavator. Because of the novel mounting arrangement provided, specialized welded-on brackets or the like are unnecessary, whereby the clamping arm assembly may be easily detached from the backhoe, and transferred to another machine if desired.

The clamping arm assembly of the subject invention includes an arm link which is adapted to be mounted in fixed abutting relation with the lower surface of the dipper arm of the backhoe. A clamping arm is pivotally connected to the arm link and extends therefrom for pivotal movement. An arm fluid actuator extends between the arm link and the clamping arm. The actuator includes a first end pivotally connected to the arm link spaced from the pivotal connection of the clamping arm. A second end of the fluid actuator is pivotally connected to the clamping arm, whereby selective actuation of the actuator provides selective pivoting movement of the clamping arm toward and away from engagement with the backhoe bucket. In this way, a claw-like action is provided for grasping objects otherwise not easily moved by the backhoe bucket alone.

In accordance with the subject invention, a novel mounting arrangement is provided for detachably mounting the arm link in fixed abutting relation to the lower surface of the dipper am of the backhoe. The mounting arrangement includes a pair of mounting plates each preferably disposed on a respective side of the dipper arm. Lower portions of the mounting plates support the arm link of the assembly. Each of the mounting plates is supported by and engageable with first and second support pins provided on the dipper arm of the backhoe. In the preferred embodiment, these support pins respectively comprise a bucket pivot pin which pivotally supports the bucket on the dipper arm, and a link pivot pin which supports pivot links of the linkage operatively connecting the bucket with its fluid actuator. Each of the mounting plates includes cutout portions which are adapted to engage the respective pins, and accommodate disengagement therefrom.

The mounting arrangement of the subject invention further includes a lock bolt threaded to the arm link of the assembly. The lock bolt is arranged such that the pivotal connection of the clamping arm to the arm link is intermediate of the lock bolt and the one end of the arm fluid actuator connected with the arm link. The lock bolt is adapted to be moved between a lock position and an unlock position. In the lock position, the lock bolt is moved into engagement with the lower side of the dipper arm, so that each of the mounting plates is maintained in engagement with the link and bucket pivot pins on the dipper arm. In this position of the lock bolt, the arm link is maintained in fixed, abutting relation to the lower surface of the dipper arm. Actuation of the arm fluid actuator pivots the clamping arm relative to the arm link (and the dipper arm) so that objects may be grasped between the clamping arm and the backhoe bucket. When use of the clamping arm is not required, it is movable to a position adjacent the dipper arm wherein the arm fluid actuator is in an overcenter condition, thus locking the clamping arm in a stowed position.

When it is desired to remove the clamping arm assembly from the backhoe, the lock bolt provided on the arm link of the assembly is moved to its unlock position. The bolt is moved away from the lower surface of the dipper arm, which permits the cutout portions of the mounting plates to be disengaged from the pivot pins by which they are supported on the dipper arm. Disengagement of the mounting plates from the pivot pins permits detachment of the entire clamping arm assembly from the dipper arm of the backhoe (after, of course, detachment of the hydraulic fluid supply to the arm fluid actuator). Thus, the entire clamping arm assembly is easily detached from the backhoe, and may then be easily transferred and fitted to another similar backhoe or other excavator. Thus, a novel clamping arm assembly for a backhoe is provided which precludes the necessity of special mounting brackets or the like thereby facilitating transfer of the assembly from one machine to the other.

BRIEF DESCRIPTION OF THE DRAWINGS

FIG. 1 is a partial perspective view of a dipper arm and bucket assembly of a backhoe including a clamping arm assembly of the subject invention;

FIG. 2 is a side elevational view of the clamping arm assembly shown in FIG. 1;

FIG. 3 is a view taken along lines 3—3 of FIG. 2 illustrating the arrangement of the clamping arm assembly of the subject invention;

DESCRIPTION OF THE PREFERRED EMBODIMENT

Figure 4:
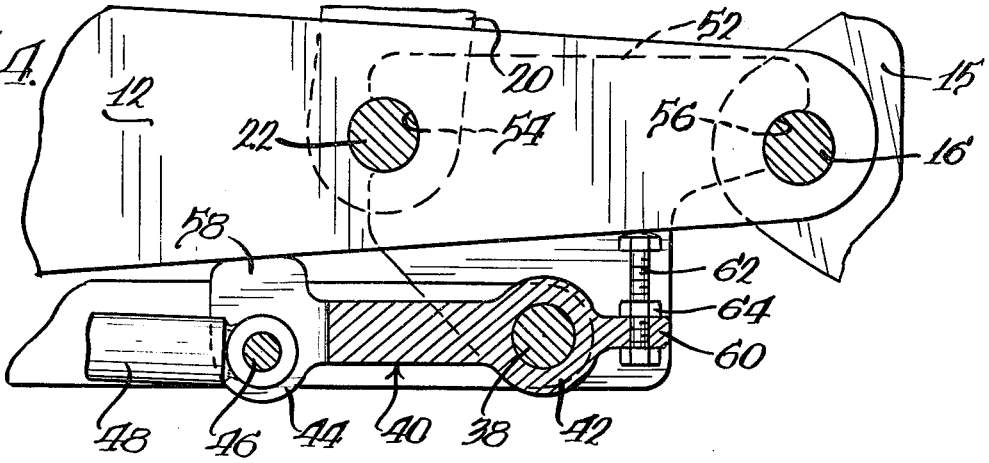
FIG. 4 is a view taken along lines 4—4 of FIG. 3.

While the subject invention is susceptible to embodiment in different forms, there is shown in the drawings and will hereinafter be described a preferred embodiment with the understanding that the present disclosure be considered as an exemplification of the invention and is not intended to limit the invention to the embodiment illustrated.

With reference now to FIG. 1, therein is illustrated a backhoe assembly 10. While the subject invention as disclosed herein is shown in conjunction with a backhoe, it would be understood by those familiar with the art that the clamping arm assembly of the subject invention is equally suitable for use with similar excavating equipment.

Backhoe assembly 10 includes a dipper arm 12 which is supported for articulated movement by a ground supported frame (not shown). The backhoe assembly 10 includes a bucket 14 having a pair of upstanding bucket flanges 15. The bucket 14 is pivotally connected to the dipper arm 12 by a bucket pivot pin 16 for pivotal movement about a horizontal axis. A bucket fluid ram 18 (only a portion of which is shown) provides selective pivoted movement of the bucket 14 through a bucket linkage. The bucket linkage includes a pair of spaced pivot links 20 disposed on opposite sides of the dipper arm 12. The pivot links 20 are pivotally connected with the dipper arm 12 by link pivot pin 22, and are pivotally connected with the bucket fluid actuator 18 by pivot 24. A pair of bucket links 26 extend between the pivot 24 and a pivot 28 provided on the bucket flanges 15. Thus, actuation of the bucket fluid actuator 18 provides pivoted movement of the bucket 14 about bucket pivot pin 16.

In accordance with the subject invention, a clamping arm assembly 30 is provided on the dipper arm generally adjacent to its distal end portion. As shown in FIGS. 2 and 3, the clamping arm assembly 30 includes a clamping arm 32. Clamping arm 32 has a pair of spaced side portions 34, and a web portion 36 extending between respective ends of the side portions 34. The opposite end of the clamping arm 32 is pivotally supported by arm pivot pin 38. It will be appreciated by those familiar with the art that clamping arm 32 could easily comprise a single arm portion extending from only one side of the arm pivot pin 38.

The clamping arm assembly 30 further includes arm link 40 which is adapted to be maintained in fixed abutting relation to the lower surface of the dipper arm 12. Arm link 40 includes a sleeve portion 42 which supports the arm pivot pin 38. In the preferred embodiment, arm link 40 further includes a pair of bifurcated pivot supports 44 which are spaced from sleeve portion 42. Pivot supports 44 support a pivot pin 46 for pivotally connecting one end of an arm fluid actuator 48 to arm link 40. The other end of arm fluid actuator 48 is pivotally connected with clamping arm 32 by arm actuator pivot 50 which extends between side portions 34 of the clamping arm 32. Arm fluid actuator 48 comprises a typical double acting fluid ram, and is suitably connected to a source of pressurized hydraulic fluid as schematically shown in FIG. 5*a*. Thus, actuation of arm fluid actuator 48 provides selective pivoting movement of the clamping arm 32 with respect to the arm link 40 as will be described.

In accordance with the subject invention, clamping arm assembly 30 further includes a pair of mounting plates 52. Mounting plates 52 are disposed on respective sides of the dipper arm 12. Each mounting plate includes cutout portions 54 and 56. It will be observed that each cutout portion 54 is generally semi-circular, while each cutout portion 56 subscribes an arc which is somewhat more than 90 degrees. As clearly shown in FIGS. 2, 3 and 4, the cutout portions 54 and 56 are adapted to respectively engage end portions of link pivot pin 22 and bucket pivot pin 16 which extend beyond the opposite sides of the dipper arm 12. Specifically, cutout 54 of each mounting plate 52 engages link pivot 22 outboard of pivot links 20. Similarly, cutout portion 56 of each mounting plate 52 is adapted to engage bucket pivot pin 16 outboard of bucket flanges 15. Thus, support of each of the mounting plates 52 is provided by its engagement with respective end portions of link and bucket pivot pins 22 and 16. It should be noted that support of the mounting plates 52 in accordance with the subject invention requires a pair of spaced support pins on the dipper arm 12. In the preferred embodiment, these support pins are provided by pivot pins 22 and 16 as described. However, a suitable support pin arrangement could be easily provided on the dipper arm if it were desired not to use the pivot pins 22 and 16 as shown.

With reference now to FIG. 4, the detachable mounting arrangement of the clamping arm assembly 30 is further shown. Arm link 40 includes an abutment portion 58. Abutment portion 58 may be provided atop each of the pivot supports 44 of arm link 40 such that abutment portion 58 is discontinuous. If desired, however, abutment portion 58 may extend between pivot supports 44 and thus include a generally continuous surface. Abutment portion 58 is adapted to abut and seat against the lower surface of the dipper arm 12. Detachable mounting of the clamping arm assembly 30 is further provided by inclusion of a lock bolt 62 which is threaded to a lock portion 60 of the arm link 40. Rotation of the lock bolt 62 with respect to arm link 40 shifts the bolt with respect thereto. A lock nut 64 is provided on the lock bolt 62 and is engageable with lock portion 60 whereby lock bolt 62 may be lockingly maintained in position with respect to arm link 40.

OPERATION

The details of attachment and detachment and operation of the clamping arm assembly of the subject invention will now be described.

Figure 6:
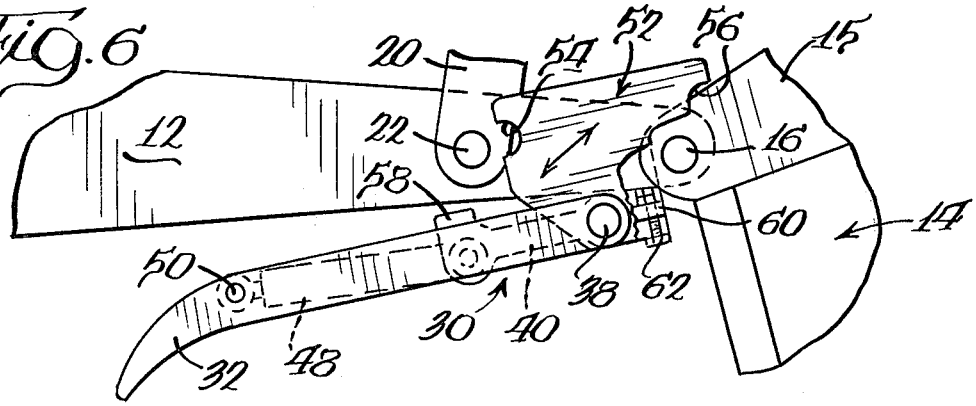
FIG. 6 is a side elevational view similar to FIG. 2 illustrating detachment of the clamping arm assembly of said invention from the dipper arm of a backhoe.

As shown in FIG. 6, clamping arm assembly 30 is essentially unitary in nature, including clamping arm 32, arm link 40, arm fluid actuator 48, and mounting plates 52. In order to attach the assembly to the dipper arm 12 of the backhoe, lock bolt 62 would be "backed out" of lock portion 60 of arm link 40 to the position shown in FIG. 6. In this position of lock bolt 62, clearance is provided between arm link 40 and the lower side of dipper arm 12 such that the entire clamping arm assembly 30 may be manipulated into and out of position with respect to the dipper arm. Specifically, cutout portions 54 and 56 of the mounting plates 52 are movable into and out of respective engagement with end portions of link pivot pin 22 and bucket pivot pin 16. Attachment of the assembly is easily accomplished by moving the mounting plates 52 into engagement with pivot pin 22 such that the pivot pin 22 fits or nests within cutout portion 54. The mounting plates 52 can then be easily shifted downwardly by pivoting them about pivot pin 22 until cutout portions 56 engage and seat against bucket pivot pin 16. Mounting plates 52 are now engaged and supported by the pivot pins 22 and 16, the configuration of cutout portions 54 and 56 preventing further downward movement of the mounting plates 52 relative to dipper arm 12.

After the mounting plates 52 have been moved into position as described, the clamping arm assembly 30 is firmly affixed to the dipper arm 12 by rotating lock bolt 62 with respect to arm link 40 so that the lock bolt 62 abuts and seats against the lower surface of the dipper arm 12. As lock bolt 62 is rotated, abutment portion 58 of arm link 40 is firmly seated in abutting relation against the lower surface of the dipper arm 12. As the lock bolt 62 is fully tightened against the lower surface of dipper arm 12, each of the mounting plates 52 is firmly seated against and engaged with respective end portions of the pivot pins 22 and 16. Thus, arm link 40 is supported by and maintained in fixed relation to the dipper arm 12 by mounting plates 52, which are supported by the pivot pins 22 and 16. After this has been accomplished, lock nut 64 provided on the lock bolt 62 is tightened against the lock portion 60 of arm link 40 so that lock bolt 62 cannot be loosened. FIG. 4 clearly illustrates this disposition of the arrangement.

With the clamping arm assembly 30 firmly attached to the dipper arm 12, arm fluid actuator 48 is connected with the pressurized hydraulic supply of the backhoe and the clamping arm is ready for use. As shown in FIG. 5*a*, a hydraulic control valve 66 ports fluid between a fluid pump and reservoir, and fluid actuator 48. FIG. 2 illustrates clamping arm assembly 30 wherein clamping arm 32 is shown in the stowed position.

It should be noted that in this position, the elements are arranged such that clamping arm 32 is disposed in an out-of-the-way position adjacent to the dipper arm 12, and is in an overcenter configuration (the axis of arm actuator pivot 50 is disposed above a line passing through the axes of pivot pins 38 and 46). In this position, clamping arm 32 shields and protects arm fluid actuator 48. Movement of clamping arm 32 and fluid actuator 48 out of and into the overcenter condition (such as before and after use of the assembly) may be accomplished by manually manipulating the arm 32 while the hydraulic control of actuator 48 is worked. In some installations, bucket 14 may be operated inwardly to engage clamping arm 32 and urge it toward the stowed position as fluid actuator 48 is operated to place it in the overcenter position. The hydraulic fluid supply to fluid actuator 48 may be provided with a fluid lock shut-off valve 68 in fluid association with the fluid actuator 48 for selectively blocking fluid flow from the actuator 48. Thus, clamping arm 32 may be securely and conveniently maintained in the stowed overcenter position when the fluid shut-off valve is closed. Preferably, fluid lock valve 68 is disposed in the hydraulic conduit which ports hydraulic fluid to and from the cylinder or head end of fluid actuator 48.

Figure 5:
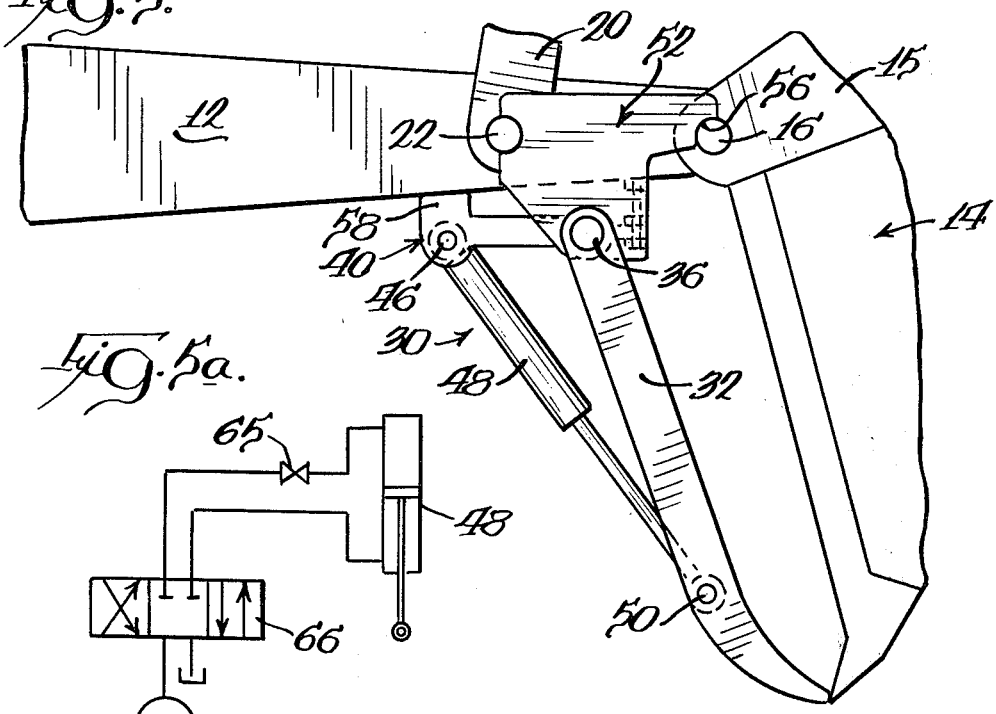
FIG. 5 is a side elevational view similar to FIG. 2 illustrating the clamping arm assembly of the subject invention in a working position.
Figure 5A:
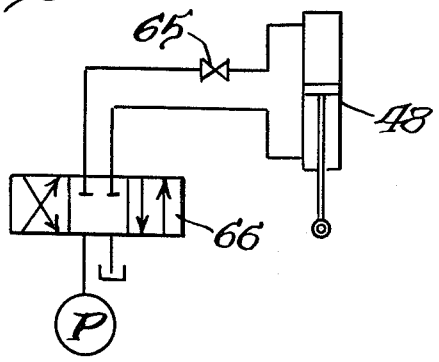
FIG. 5*a* is a schematic diagram of the hydraulic circuit of the subject invention.

FIG. 5 illustrates clamping arm 32 after it has been pivoted about pivot pin 38 by arm fluid actuator 48 into engagement with bucket 14 of the backhoe. When the clamping arm 32 is operated in conjunction with the bucket 14 it will be appreciated that a claw-like working action is provided which is particularly suitable for grasping objects otherwise not easily handled by the bucket 14 alone. The entire clamping arm assembly 30 remains firmly in position by the abutment of abutment portion 58 of the arm link 40 with, and the abutment of lock bolt 62 with the lower surface of the dipper arm 12, and by engagement of the mounting plates 52 with the end portions of the link pivot pin 22 and the bucket pivot pin 16. Significantly, the mounting arrangement of the subject invention reduces the scissors-like binding action on bucket pivot pin 16 commonly associated with prior clamping arm assemblies. Naturally, clamping arm 32 may be selectively positioned anywhere between the stowed position illustrated in FIG. 2 and the position shown in FIG. 5, and the fluid shut-off valve 68 in the hydraulic fluid supply conduit to fluid actuator 48 as may serve the further purpose of maintaining clamping force during use of clamping arm 32 if the valve is closed. It should be noted that the arrangement as provided permits the use of an arm fluid actuator 48 which is significantly shorter than the fluid actuator required by clamping arm assemblies heretofore known. This provides a clamping arm assembly of reduced weight.

In order to remove the clamping arm assembly 30 from the dipper arm 12 of the backhoe, the above-described procedure for attachment is essentially reversed. Hydraulic fluid supply connections to arm fluid actuator 48 are disconnected, and lock nut 64 loosened so that the lock bot 62 may be rotated within lock portion 60 of arm link 40. As the lock bolt 62 is backed out of lock portion 60, clearance is provided so that cutout portions 54 and 56 of mounting plates 52 may be respectively disengaged from the end portions of link pivot pin 22 and bucket pivot pin 16. As shown in FIG. 6, the entire clamping arm assembly 30 may then be shifted upwardly and easily detached from the backhoe. If desired, the clamping arm assembly 30 may now be attached to another backhoe in a similar fashion, thus providing ready adaptability of the assembly for use with more than one backhoe or excavator.

Thus, the subject invention provides an easily attachable and detachable clamping arm assembly for use with a backhoe or similar excavator for further increasing the versatility of that piece of equipment. From the foregoing, it will be appreciated that numerous variations and modifications may be affected without departing from the true spirit and scope of the novel concept of the subject invention. It will be understood that no limitation with respect to the specific apparatus illustrated herein is intended or should be inferred. It is, of course, intended to cover by the appended claims all such modifications as fall within the scope of the claims.

What is claimed is:

1. An improved detachable clamping arm assembly for use with an excavator having a dipper arm movable with respect to a ground-supported frame and a bucket pivotally supported on the distal end of said dipper arm for movement by a bucket fluid actuator, comprising:

an arm link adapted to abut the lower surface of said dipper arm in fixed relation thereto, a clamping arm pivotally connected to said arm link for pivotal movement with respect thereto, an arm fluid actuator having a first end pivotally connected to said arm link and spaced from the pivotal connection of said clamping arm to said arm link, and a second end pivotally connected to said clamping arm whereby selective actuation of said arm fluid actuator selectively pivots said arm toward and away from engagement with said bucket for grasping objects, and mounting means for detachably mounting said arm link in abutting relation to said dipper arm.

2. The improved clamping arm assembly of claim 1, wherein said mounting means includes mounting plate means, said plate means being engageable with said dipper arm and supporting said arm link.

3. The improved clamping arm assembly of claim 2, wherein said mounting means further include adjustable lock means on said arm link adapted to engage the lower surface of said dipper arm whereby in one position of said lock means said arm link is maintained in fixed abutting relation to said dipper arm, and in another position of said lock means said plate means are disengageable from said dipper arm and said clamping arm assembly is detachable from said dipper arm.

4. The improved clamping arm assembly of claim 3, wherein said plate means support said arm link intermediate of said lock means and said first end of said arm fluid actuator.

5. The improved clamping arm assembly of claims 2 or 4, wherein said plate means comprise a pair of spaced mounting plates respectively engageable with said dipper arm.

6. The improved clamping arm assembly of claim 5, wherein said dipper arm includes first and second support pins spaced from each other, and said mounting plate each respectively engages said first and second support pins.

7. The improved clamping arm assembly of claim 6, wherein said first and second support pins each have end portions extending beyond the sides of said dipper arm, and said mounting plates are respectively disposed on opposite sides of said dipper arm and respectively engage said end portions.

8. The improved clamping arm assembly of claim 6, wherein said first support pin pivotally supports said bucket on said dipper arm and said second support pin pivotally connects a linkage operatively connecting said bucket fluid actuator and said bucket with said dipper arm.

9. The improved clamping arm assembly of claim 4, wherein said lock means includes a lock bolt threaded to said arm link.

10. The improved clamping arm assembly of claim 6, and fluid lock means in fluid association with said arm fluid actuator for selectively blocking fluid flow from said arm fluid actuator.

11. The improved clamping arm assembly of claim 6, wherein each of said mounting plates define a first arcuate cutout portion engageable with said first support pin and a second arcuate cutout portion engageable with said second support pin, said second cutout portions being generally semi-circular whereby in said one position of said lock means said second cutout portions are engageable with said second support pin and said mounting plates are pivotal with respect thereto so that said first cutout portions are movable in and out of engagement with said first support pin.

12. An improved detachable clamping arm assembly for use with an excavator having a dipper arm supported by a ground-supported frame for articulated movement with respect thereto, a bucket pivotally supported by a bucket pivot pin on the distal end of said dipper arm for movement about a horizontal axis, and a bucket fluid actuator for selectively pivoting said bucket through a linkage operatively connecting said bucket fluid actuator, said linkage including a link pivot pin on said dipper arm spaced from said bucket pivot pin, comprising:

an arm link adapted to abut the lower surface of said dipper arm, a clamping arm pivotally connected to said arm link by an arm pivot pin an arm fluid actuator having one end pivotally connected to said arm link and spaced from said arm pivot pin, and another end pivotally connected to said clamping arm whereby selective actuation of said arm fluid actuator selectively pivots said arm toward and away from said bucket for accommodating grasping objects between said arm and said bucket, a pair of mounting plates disposed on respective opposite sides of said dipper arm and arm link, said mounting plates being engageable with said bucket pivot pin and said link pivot pin and supporting said arm link by said arm pivot pin, and adjustable lock bolt means threaded to said arm link, said arm pivot pin being disposed intermediate said lock bolt means and said first end of said arm fluid actuator, said lock bolt means being movable between one position wherein said mounting plates are maintained in engagement with said link and bucket pivot pins and said arm link is maintained in fixed abutting relation to the lower surface of said dipper arm, and another position wherein said mounting plates are disengageable from said link and bucket pivot pins and said clamping arm assembly is detachable from said dipper arm.

* * * * *